US005469674A

United States Patent [19]

Morello

[11] Patent Number: 5,469,674

[45] Date of Patent: Nov. 28, 1995

[54] ARCHED ROOF VERTICAL WALL SELF SUPPORTING METAL BUILDING CONSTRUCTIONS

[75] Inventor: Frederick Morello, Johnston, Pa.

[73] Assignee: M.I.C. Industries, Inc., Reston, Va.

[21] Appl. No.: 345,322

[22] Filed: Nov. 21, 1994

Related U.S. Application Data

[60] Continuation of Ser. No. 40,009, Mar. 30, 1993, which is a division of Ser. No. 872,005, Apr. 22, 1992, Pat. No. 5,249,445.

[51] Int. Cl.[6] ..... E04B 1/32; E04C 2/32

[52] U.S. Cl. ..... 52/86; 52/220.2; 52/220.4; 52/425; 52/429

[58] Field of Search ..... 52/86–88, 91.1, 52/220.2, 220.4, 414, 424, 425, 429, 436, 437, 795–797

[56] References Cited

U.S. PATENT DOCUMENTS

| | | | |
|---|---|---|---|
| 2,436,543 | 2/1948 | Blaski | 52/86 X |
| 2,526,326 | 10/1950 | Blaski | 52/86 X |
| 2,722,901 | 11/1955 | Johnson et al. | 52/91.1 |
| 2,975,559 | 3/1961 | Hedgres | 52/220.4 X |
| 2,986,193 | 5/1961 | Howell . | |
| 3,059,734 | 10/1962 | Trip | 52/796 X |
| 3,150,707 | 9/1964 | Howell . | |
| 3,173,225 | 3/1965 | Goodwill et al. | 52/86 X |
| 3,670,553 | 6/1972 | Nothum et al. . | |
| 3,831,421 | 8/1974 | Koger, Jr. et al. . | |
| 3,842,647 | 10/1974 | Knudson . | |
| 3,875,642 | 4/1975 | Knudson . | |
| 3,902,288 | 9/1975 | Knudson . | |
| 3,955,389 | 5/1976 | Foster . | |
| 3,967,430 | 7/1976 | Knudson . | |
| 3,968,603 | 7/1976 | Merson | 52/86 |
| 4,039,063 | 8/1977 | Knudson . | |
| 4,080,815 | 3/1978 | Foster . | |
| 4,205,544 | 6/1980 | Foster . | |
| 4,364,253 | 12/1982 | Knudson . | |
| 4,470,186 | 9/1984 | Knudson . | |
| 4,505,084 | 3/1985 | Knudson . | |
| 4,505,143 | 3/1985 | Knudson . | |
| 4,759,159 | 7/1988 | Blazely | 52/86 |

FOREIGN PATENT DOCUMENTS

| | | | |
|---|---|---|---|
| 0997117 | 9/1976 | Canada | 52/86 |
| 1017523 | 9/1977 | Canada | 52/86 |
| 2008999 | 6/1979 | United Kingdom . | |

*Primary Examiner*—Carl Friedman
*Assistant Examiner*—Robert J. Canfield
*Attorney, Agent, or Firm*—Rothwell, Figg, Ernst & Kurz

[57] ABSTRACT

A metal building is formed of adjacent preformed panels of generally U-shape with crimpable edges, the edges of adjacent panels being crimped together to form the building, the building having straight side walls and a continuous arched curved roof in which the side walls are reinforced by similar shaped straight panels positioned against the side walls to form cavities, which cavities may be filled with reinforcing material, electrical conduits and the like.

5 Claims, 3 Drawing Sheets

ARCHED ROOF VERTICAL WALL SELF SUPPORTING METAL BUILDING CONSTRUCTIONS

This is a continuation of application Ser. No. 08/040,009, filed Mar. 30, 1993, which is a divisional application of application Ser. No. 07/872,005 filed Apr. 22, 1922, now U.S. Pat. No. 5,249,445.

BACKGROUND OF INVENTION

1. Field of the Invention

This invention relates to improvements in building configurations, and more particularly relates to improved vertical wall construction in an arched roof, vertical wall, self supporting metal buildings formed of adjacent seamed together panels.

2. Background and Prior Art

It is known in the prior art to make metal buildings from adjacent formed metal building panels which are arched or curved, assembled side by side and seamed together. See for example, Knudson U.S. Pat. No. 3,902,288 (1975) for showing of such building in which the roof panels are completely curved or arched and extend to the foundation. In such buildings the roof panels continue as the side walls of the building and the basic building construction is in the shape of a continuous arch or semi-circle when viewed from the end. A machine for making the metal panels for such building in which the formed panels are corrugated not only on the side edges of the box, but also on the bottom to create the curvature is shown in Knudson U.S. Pat. No. 3,842,647 (1974). A method of building the building by adjacent panels which are seamed together is disclosed in Knudson U.S. Pat. No. 3,967,430 (1976). A seamer for forming the seams between the adjacent panels of the prior Knudson patents is shown in Knudson U.S. Pat. No. 3,875,642 (1975). The prior art represented by the Knudson patents is owned and has been commercialized by MIC Industries, Inc. of Reston, Virginia in its mobile K-Span® machines.

The Howell U.S. Pat. Nos. 2,986,193 (1961) and 3,150,707 (1964) show arched roof building constructions in FIGS. 18 and 20 with the building in FIG. 20 having an arched roof and vertical side walls with different curvatures between the side walls and the roof. It is believed that no buildings, according to this patent were ever built (because of the extreme difficulty and complexity to build the same).

There is a problem in the art with regard to arched roof metal buildings with straight vertical side walls which is that the side walls may not have enough strength to support a large building under heavy load i.e., wind and/or live loads.

An arched building construction i.e., construction of which walls and roof are completely arched has advantages, but also, a number of limitations. One limitation is the absence of vertical walls which limits the use of vertical space. Often users of metal buildings want vertical walls both for aesthetic purposes and to allow more use of space near the edges of the building. Additionally, known prior art machines had a limitation on the thickness of steel used in forming the metal panels, because of machine limitations. The basic size and strength of such metal buildings is also limited by local wind and live load limitations as established by building codes throughout the nation and the world. As these building code standards become more conservative, a builder is effectively limited to only certain size buildings. The complete arched building must be limited in size in order to prevent overloading such as could occur from extensive wind loads produced by hurricanes. However, when the total roof height is reduced to approximately one-fifth of the total building width, hurricane force winds do not affect the building as much, because of reduced frontal area. Thus, there is a need in the art for a metal building formed of continuous panels which is not completely arched but has straight vertical walls while utilizing the economy of the seamed panel construction of the prior art. Such vertical wall buildings would satisfy a need in the art for space, economy, usefulness and strength.

Another, deficiently in the prior art arched panel forming machines is that they do not produce straight sections and curved sections together on the same panel. Furthermore, straight panels formed seperately and used as vertical wall building panels are weak because they are not crimped. In other words with the existing technology, crimping Just the side walls of the panels cannot be accomplished. But there is a need in the art to provide for a crimping of the side walls of straight panels used as vertical building walls.

There is also need in the art for an improved building method for Joining multiple buildings together and providing column support for the side walls without significant conditional components.

SUMMARY OF THE INVENTION

The invention includes a building method and a building construction in which multiple buildings are joined together without additional columnar support, i.e., using the side walls as columns. This is accomplished by assembling two vertical panels back to back to provide a stiff column with an extruded fastening member reinforcing bars and concrete within the space between the vertical panels.

DETAILED DESCRIPTION OF THE PREFERRED EMBODIMENTS

Figure 1:
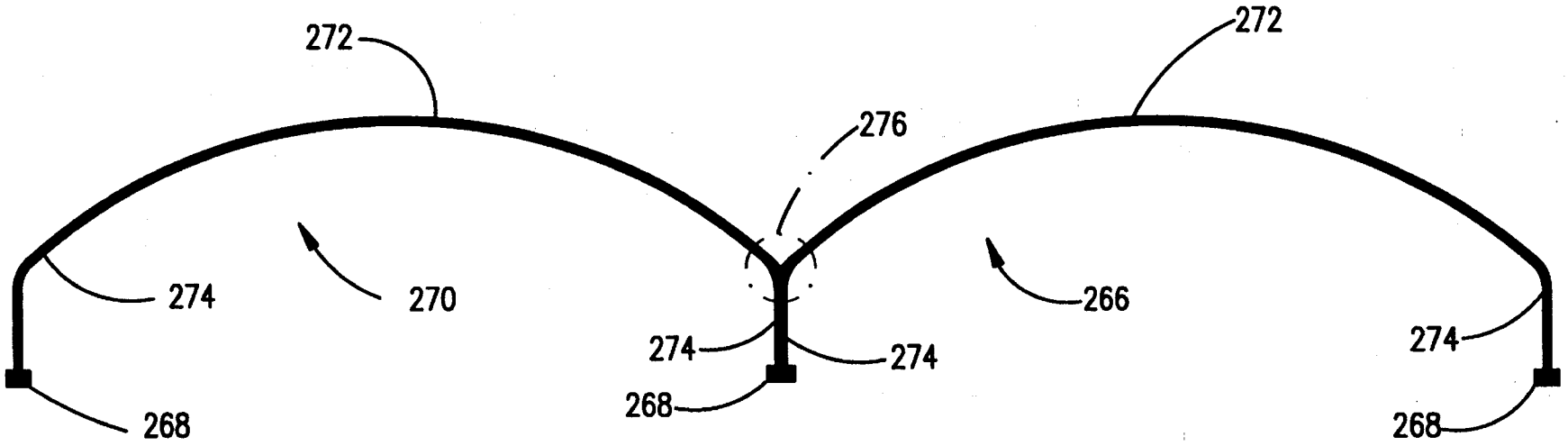
FIG. 1 is a schematic end elevation view of one shape of a building that can be made using this invention.

FIG. 1 shows one type of building that can be built with this invention. A first building unit includes a panel span 270 has an arched roof 272 sandwiched between two vertical wall portions 274. A second adjacent building unit includes a panel span 266 and has an arched roof 272 and vertical wall portions 274. The first and second panel spans 266, 270 are formed of seamed together first and second pluralities of panels The entire two-unit building includes a common vertical wall 276 which is formed by a straight end portion of one panel span 266 and a straight end portion of another panel span 270 placed in back-to-back position as seen in FIG. 1. The end portions are held together by fasteners 284 as discussed below. This invention can also be used to construct a single or multiple unit building. The assembly may conveniently be erected on footings or foundations 268 as is known in the art.

Figure 2:
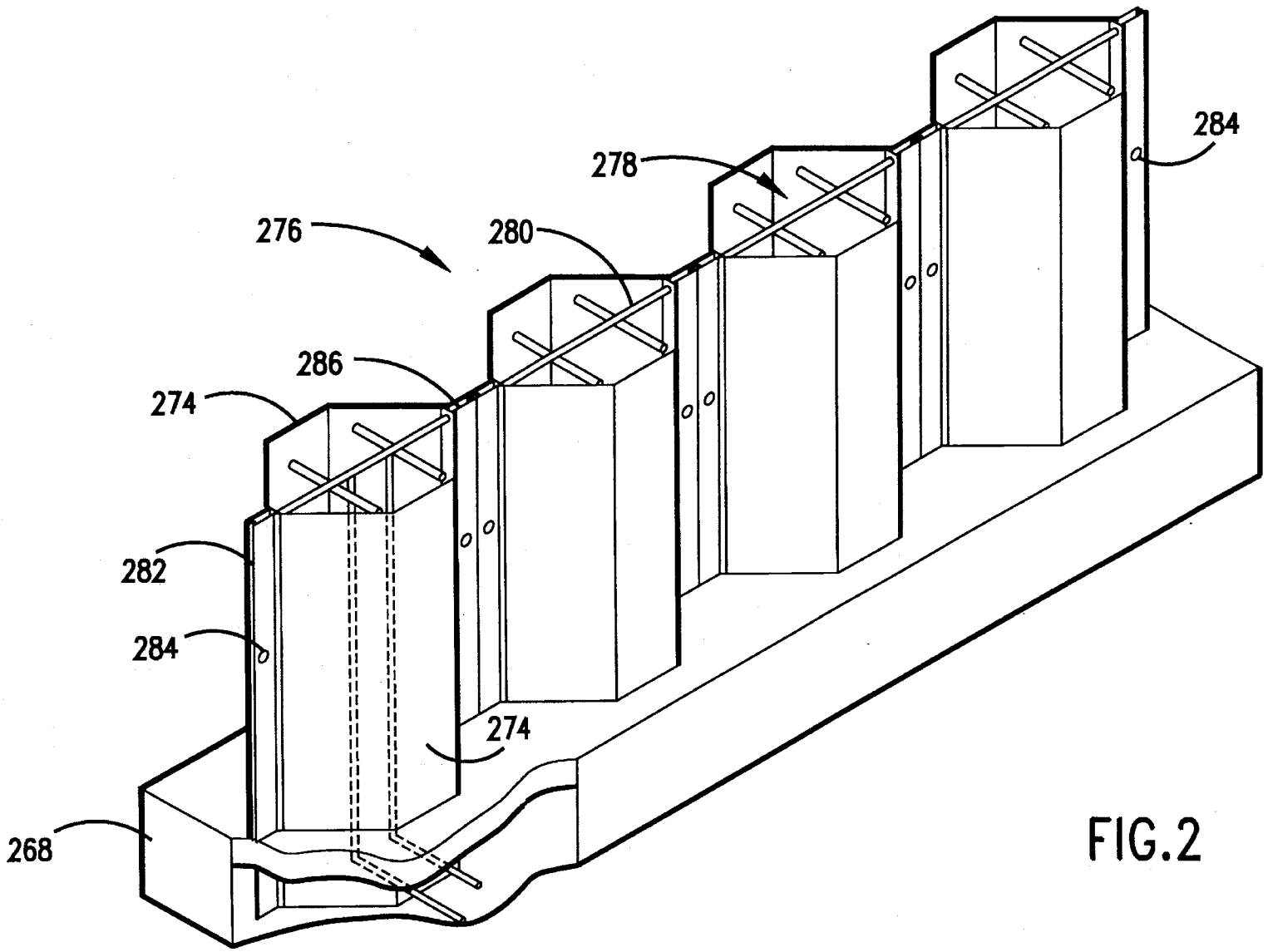
FIG. 2 is a perspective view illustrating a detail of the building of FIG. 1 showing the assembly where the building is assembled, and illustrating the self support.

A detail of the common vertical wall 276 is shown in FIG. 2. The straight end portions of the respective panel spans when assembled together form a section with cavities of hexagonal or honeycomb shape 278. Reinforcing bar assemblies 280 may be placed in these cavities and the cavities may be filled with concrete (not shown) for rigidity and support. Extruded aluminum panel members 282 may be assembled between the panels and attached by fasteners 284 passing through the extruded members 282 and the building panels to secure the panels together in a back to back manner. Electrical conduits may be passed through cavities 286 in the extruded members 282, which may be hollow with the cavities 286 passing therethrough, or may be passed through certain of the cavities 278 which then would not be filled with concrete.

Figure 3:
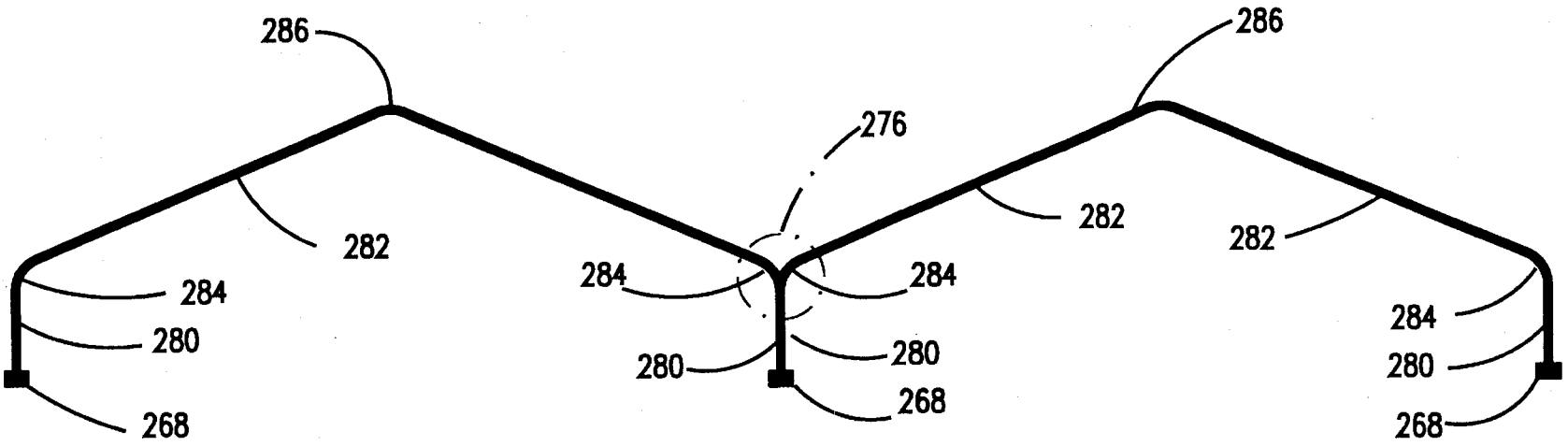
FIG. 3 is a schematic end elevation view of another shape of building which can be made using this invention.

FIG. 3 depicts another form of completed building structure. These buildings maybe formed of panels having straight vertical walls 280, separated from the sloping straight roof portion 282 by a curved section 284. A small curved section 286 at the apex of the building will complete the shape. Buildings having two or more units can be constructed by using the vertical column support (common vertical wall) 276 as previously described. This concrete vertical column can also be used on straight vertical walls in single-unit buildings as well. A single-unit building would include a pair of straight, vertical, common walls 276 defined by fastening together each of the straight end portions of the arched panel assembly, (i.e., the panels which form the curved roof of the building unit), to a panel assembly including seamed-together panels that are straight over their entire length as seen in FIG. 2, with the length of the latter panels corresponding to the height of the vertical walls of the building. It is the intention therefore to be limited only by the scope of the appended claims.

What is claimed is:

1. A metal building erectable on site, the building having first and second adjacent units each of which has a roof structure and two vertical walls, the building comprising:

a first plurality of metal panels formed to a desired cross section of generally U-shape and having edges, the panels being assembled side-by-side and connected together by seams formed in adjoining edges of adjacent panels;

each of said panels having a portion thereof which is curved to form the roof structure of one of said building unit, and each panel having two ends and a portion at both ends thereof which is straight to form the vertical walls of said one building unit; and a second plurality of metal panels seamed together side-by-side with each of said second plurality of panels having a cross section of generally U-shape and two ends each including a straight portion such that each of the second plurality of panels are shaped substantially the same as each of the first plurality of panels, the first and second pluralities of seamed together panels being assembled in back-to-back relationship with the seams located at one of the two straight end portions of the first plurality of panels in contact with the seams located at one of the two straight end portions of the second plurality of panels;

wherein the back-to-back assembled straight end portions of the respective pluralities of U-shape panels form a hollow core which forms a common vertical wall that defines one vertical wall of the first of said adjacent building units and one vertical wall of the second of said adjacent building units.

2. A metal building as in claim 1, wherein the hollow core is filled with reinforcing material.

3. A metal building as in claim 2, wherein the hollow core contains electrical conduits.

4. A metal building as in claim 3, wherein the hollow core contains concrete.

5. A metal building erectable on site, the building having at least one building unit including a curved roof structure and two straight vertical walls, the building comprising:

a first plurality of metal building panels formed to a desired cross section of generally U-shape and having edges, the first plurality of building panels being assembled side-by-side and connected together by seams formed in adjoining edges of adjacent building panels;

each of said first plurality of building panels having an arched portion which forms the curved roof structure of said at least one building unit, and two ends with a portion of each of said two ends being straight to form the straight vertical walls of said at least one building unit; and at least a second plurality of metal building panels having a generally U-shape and edges, the second plurality of building panels being assembled side-by-side and connected together by seams formed in adjoining edges of adjacent building panels;

each of said second plurality of building panels having two ends and a length, each of the second plurality of panels being straight over said length thereof; and wherein the first and second pluralities of seamed-together panels are assembled and fastened together in back-to-back relationship, with the seams located at one of the two straight end portions of the first plurality of arched panels contacting the seams formed between adjoining edges of the second plurality of straight panels;

whereby the back-to-back assembled first and second pluralities of U-shaped building panels form at least one of said straight vertical walls of said least one building unit.

* * * * *

UNITED STATES PATENT AND TRADEMARK OFFICE

CERTIFICATE OF CORRECTION

PATENT NO. : 5,469,674

DATED : November 28, 1995

INVENTOR(S) : Frederick Morello

It is certified that error appears in the above-indentified patent and that said Letters Patent is hereby corrected as shown below:

Col. 1, line 15, "construction" should be -- constructions --; Col. 2, line 22, "Joining" should be -- joining --; Col. 2, line 50, after "span 270" insert -- and --; Col. 2, line 56, after "panels" insert a period; Col. 3, line 30, after "building." insert -- As can be seen this invention provides a unique and a new building type. --.

Signed and Sealed this

Twenty-second Day of October, 1996

*Attest:*

Bruce Lehman

BRUCE LEHMAN

*Attesting Officer*

*Commissioner of Patents and Trademarks*